United States Patent [19]

Habegger et al.

[11] Patent Number: 4,457,035

[45] Date of Patent: Jul. 3, 1984

[54] SUSPENSION BRIDGE AND METHOD OF ERECTING SAME

[75] Inventors: Willy Habegger, Hünibach; Ernst Lauber, Thun, both of Switzerland

[73] Assignee: Willy Habegger AG, Thun, Switzerland

[21] Appl. No.: 366,356

[22] Filed: Apr. 7, 1982

[30] Foreign Application Priority Data

Apr. 10, 1981 [DE] Fed. Rep. of Germany ..... 3114532

[51] Int. Cl.[3] ..... E01D 11/00

[52] U.S. Cl. ..... 14/18; 14/73

[58] Field of Search ..... 14/18, 19, 20, 1, 73, 14/21, 22, 14, 27, 2.4, 2.6

[56] References Cited

U.S. PATENT DOCUMENTS

| | | | |
|---|---|---|---|
| 510,674 | 12/1893 | Cameron | 14/18 |
| 951,874 | 3/1910 | Wood | 14/18 |
| 2,016,191 | 10/1935 | Cordova | 14/18 |
| 2,311,241 | 2/1943 | Martin | 14/21 |
| 2,878,498 | 3/1959 | Gollnow | 14/19 X |
| 3,504,389 | 4/1970 | Longbottom | 14/27 X |
| 3,859,000 | 1/1975 | Webster | 14/27 X |
| 4,062,081 | 12/1977 | Ramer | 14/1 |
| 4,352,220 | 10/1982 | Wittfoht | 14/1 |

*Primary Examiner*—Ernest R. Purser
*Assistant Examiner*—Beverly E. Hjorth
*Attorney, Agent, or Firm*—Karl F. Ross; Herbert Dubno

[57] ABSTRACT

A suspension bridge has a pair of horizontally spaced towers between which is spanned a main catenary cable. A flexible spacer element, normally a cable, extends along the main cable between the towers and is provided with generally equispaced spacers. Respective hanger assemblies are fixed at the spacers and can slide on the main cable between the towers. Respective upright hangers defining a vertical plane with the main cable have upper ends connected to the hanger assemblies and lower ends and are provided with adjusters between these ends for shortening and lengthening the distance therebetween. Respective girders are secured to the lower ends and extend generally perpendicular to the plane and respective path sections extend generally horizontally and each have one end hooked over a respective one of the girders and another end hooked over an adjacent girder. The sections each have an effective length between the respective girders equal generally to the distance between adjacent spacers of the spacer element and they together form a continuous path between the towers.

14 Claims, 13 Drawing Figures

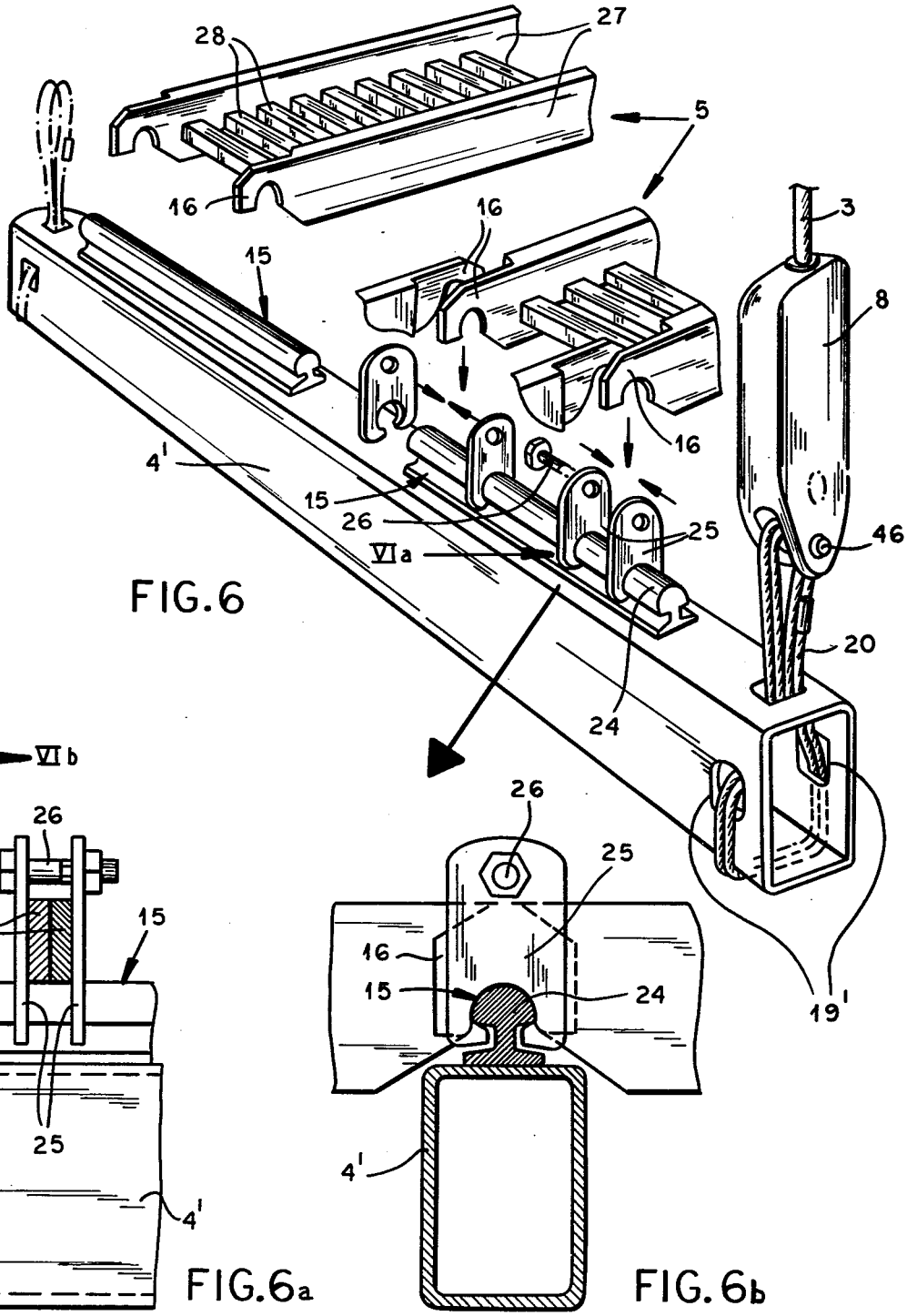
FIG.6
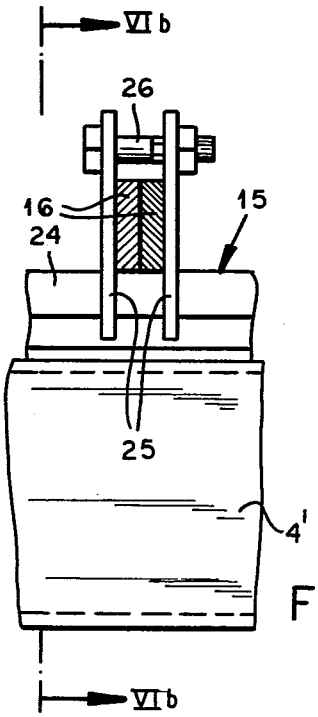
FIG.6a
FIG.6b

SUSPENSION BRIDGE AND METHOD OF ERECTING SAME

FIELD OF THE INVENTION

The present invention relates to a suspension bridge. More particularly this invention concerns such a bridge that can be erected rapidly and a method of erecting it.

BACKGROUND OF THE INVENTION

A suspension bridge normally consists of two towers that are mounted on opposite sides of a river bank, gorge, or the like, a main catenary cable spanned between them, and some sort of roadway or path suspended from the catenary cable. Such constructions can be huge engineering projects supporting several levels of multilane highway, or can be army or emergency-type structures that are erected on a temporary basis for relatively light traffic.

U.S. Pat. No. 411,499 of W. H. C. Greer of Sept. 24, 1889 describes what was for its day a heavy-duty suspension bridge. It was equipped with vertical suspenders, the elements by means of which the roadway or path is suspended from the main catenary cable, that could be shortened and lengthened to compensate for shifting of the towers or surrounding structure. Thus the bridge was adjustable.

In suspension bridges there is normally a tradeoff between ease of construction and safety of use. Thus light-duty suspension bridges erected for temporary military or emergency use which are simple enough to be erected by unskilled personnel can normally only be safely used by trained soldiers or mountaineers. Those that are so complex that they can only be erected by bridge engineers can normally be safely used by even the aged and infirm. Both types normally require extensive preparation at least, with complex preparation of anchors for the critical ends of the main cable and construction of tall support towers.

OBJECTS OF THE INVENTION

It is therefore an object of the present invention to provide an improved suspension bridge.

Another object is the provision of such a suspension bridge which overcomes the above-given disadvantages.

A further object is to provide an improved method of erecting or building a suspension bridge.

Yet another object is to provide a suspension bridge which can be erected by any person with any mechanical aptitude, yet which is a safe and solid bridge when completed.

Another object is to provide such a bridge which can be carried to and erected in remote locations working, if necessary, almost entirely from one side.

SUMMARY OF THE INVENTION

These objects are attained according to the instant invention in a suspension bridge having a pair of horizontally spaced towers between which is spanned a main catenary cable. A flexible spacer element, normally a cable, extends along the main cable between the towers and is provided with generally equispaced spacers. Respective hanger assemblies are fixed at the spacers and can slide on the main cable between the towers. Respective upright hangers defining a vertical plane with the main cable have upper ends connected to the respective hanger assemblies and lower ends and are provided with respective means between these ends for shortening and lengthening the distance therebetween. Respective girders are secured to the lower ends and extend generally perpendicular to the plane and respective path sections extend generally horizontally and each have one end hooked over a respective one of the girders and another end hooked over an adjacent girder. The sections each have an effective length between the respective girders equal generally to the distance between adjacent spacers of the spacer element and they together form a continuous path between the towers.

Such a bridge is made according to this invention by first erecting the towers and spanning the main cable between the erected towers. A hanger assembly is fitted at one of the towers to the spanned main cable and is secured to a respective one of the spacers of the spacer element. A hanger is then secured in turn to this hanger assembly and a girder to this hanger to form a hanger unit slidable along the main cable and attached to the respective one spacer. One end of a path section is coupled to the girder of the hanger unit at the one tower. Then the one spacer is pulled with the respective hanger unit attached to it from the one tower toward the other tower through a distance along the main cable equal generally to the distance between adjacent spacers on the spacer element. These steps are repeated to make another hanger unit at the next spacer along the spacer element and the other end of the partially coupled path section is coupled to it with one end of yet another path section. Successive hanger assemblies, hangers, girders, and roadway sections are thus united to form of the sections a continuous path extending between the towers. The distance between the upper and lower ends of the suspenders is then adjusted by means of the mechanisms to straighten the path.

The spacer element therefore serves the function both of spacing the bridge units and of allowing them to be pulled across between the towers. At the start, until the leading end of the bridge reaches the bottom of the catenary cable, the spacer cable is merely payed out with gravity taking the bridge along. From the bottom the bridge must be hauled up to the other side, which can be done by looping the spacer cable back to the main tower and pulling from there. All assembly work is done on firm ground. Only the eventual leveling of the roadway is carried out between the towers, but this adjustment can be done by a person standing securely on a roadway section which at its most inclined will be parallel to the steepest part of the catenary.

According to another feature of this invention the towers each have a plurality of legs formed of longitudinally interfitted separable leg sections and a holder for the respective end of the main cable. These leg sections are made of a light metal and are provided with interfittable ends. Each of the supports has at least three such legs and a cap at the upper ends thereof and is provided with a pulley arrangement constituting the respective holder. In addition the lower ends may, in case of soft ground, be provided with horizontal disks by means of which they bear on the ground. Such a tower can be easily carried to a site and erected, even by a single man. The towers each comprise a closed loop of cable connected to the respective lower leg ends. Thus the tripod arrangement can be fitted together on the ground and tipped up, then have its legs spread to give it a stable stance. The legs are only subject to longitudinal compression, so that once properly assembled even a relatively light tower can support a considerable load. Then the anchor for the end of the main cable is prepared. Aside from this the person at this site need merely handle the lead lines, once again something that one person can do easily.

According to this invention the path sections have ends formed with downwardly open recesses receiving the respective girders and linking each path section at each of its ends to the respective girder for pivoting relative thereto generally about the axis of the respective girder. The bridge further comprises means for securing the path-section ends down on the respective girders. In this manner the roadway is effectively an articulated chain.

The girders according to this invention can be formed as generally cylindrical tubes and the means for securing can include respective cables attached underneath the tubes to path-section ends of adjacent path sections. In this arrangement the suspenders include suspender cables looped through the girders at the ends therof. It is also possible for the girders to carry respective profiled support rails over which the recesses fit and to which the securing means secure the path-section ends. In this case the securing means includes respective pairs of holder plates longitudinally slidable along the rails and bolts securing each pair of holder plates to the sides of adjacent path-section ends.

In accordance with another feature of this invention the path sections each include two parallel box-beam longitudinal members and transverse members bridging same. These can be made wholly of aluminum. The transverse members may be square-corrugated sheet aluminum known for high strength and low weight.

In addition each hanger assembly includes three parts forming an upper passage for the main cable, a lower passage for the spacer element, and a transverse rod securing the parts together and securing the respective upper suspender or hanger end to them. Such a hanger assembly in fact may be provided with means for clamping it to the main cable, so that the entire system can be stabilized once the bridge is completely erected and adjusted.

DESCRIPTION OF THE DRAWING

The above and other features and advantages will become more readily apparent from the following, reference being made to the accompanying drawing in which:

FIGS. 5 and 6 are exploded perspective views of details of FIGS. 1 and 2, respectively;

FIG. 6*a* is a view taken in the direction of arrow VIa of FIG. 6 but showing the parts in assembled condition;

FIG. 6*b* is a section taken along line VIb—VIb of FIG. 6*a;*

SPECIFIC DESCRIPTION

Figure 1:
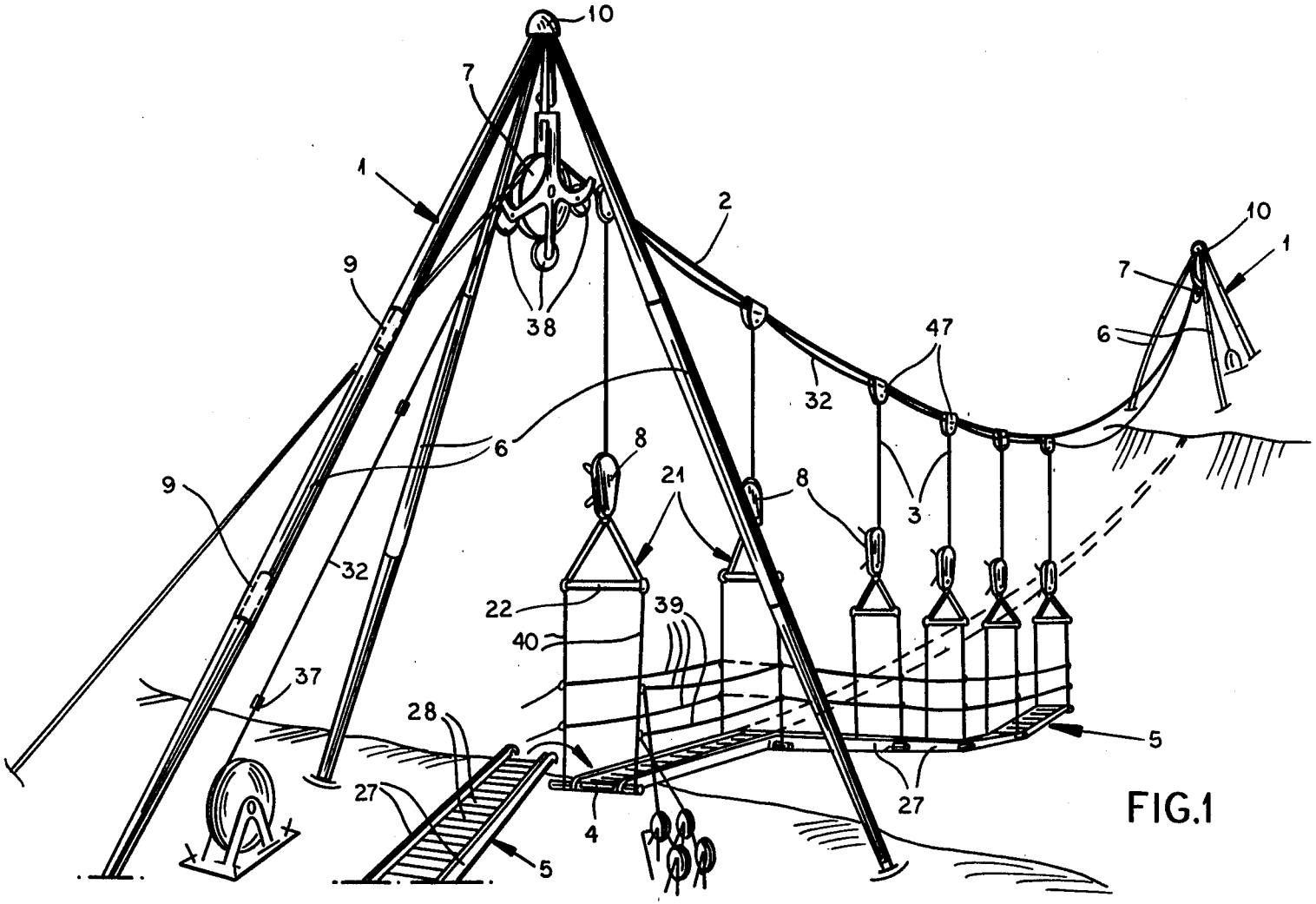
FIG. 1 is a perspective view of a one-cable suspension bridge according to this invention.

The suspension bridge of FIG. 1 has a pair of towers 1 supporting a catenary main cable 2 from which hang a succession of suspenders 3 provided with adjustable ratchet-action adjustment mechanisms or winches 8 which in turn carry respective transverse girders 4 supporting path or roadway sections 5.

Figure 3:
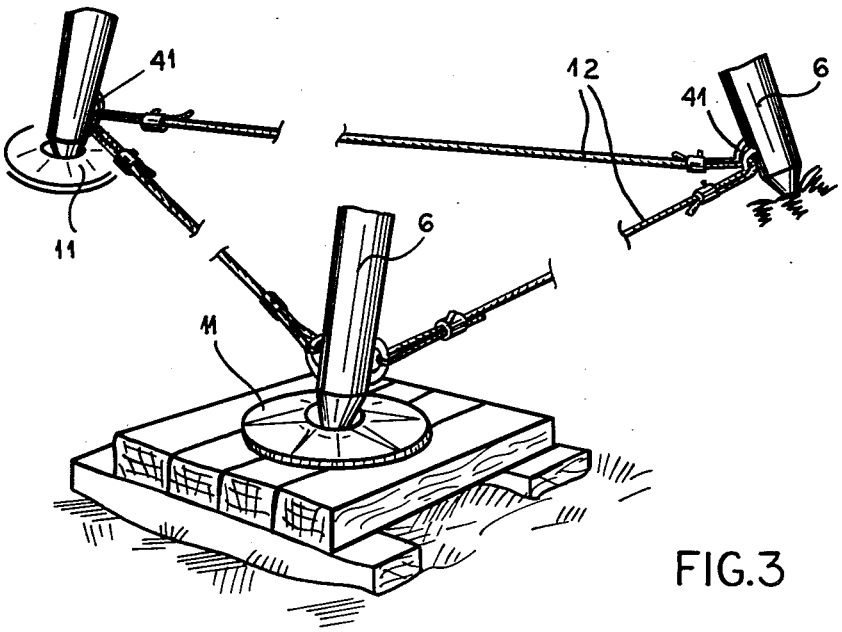
FIG. 3 is a large-scale view of a detail of FIG. 1.

The towers 1 are each formed as a tripod each of whose legs is formed by a plurality of longitudinally interfitting aluminum leg sections 6 having end fittings 9 that allow them to be solidly connected together longitudinally. Each tower 1 has a top cap 10 from which is hung a pulley 7 over which the respective end of the main cable 2 is reeved. The lowermost sections 6 are pointed as shown in FIG. 3 and may poke directly into the ground or stand on a plate 11 having a suitable center depression to center the respective leg section 6 so that the force is distributed and its end does not sink into the ground. In addition an endless cable loop 12 passes through eyes 41 at the lower end of the lowermost leg section 6 to limit the spread of the tripod tower 1.

Figure 2:
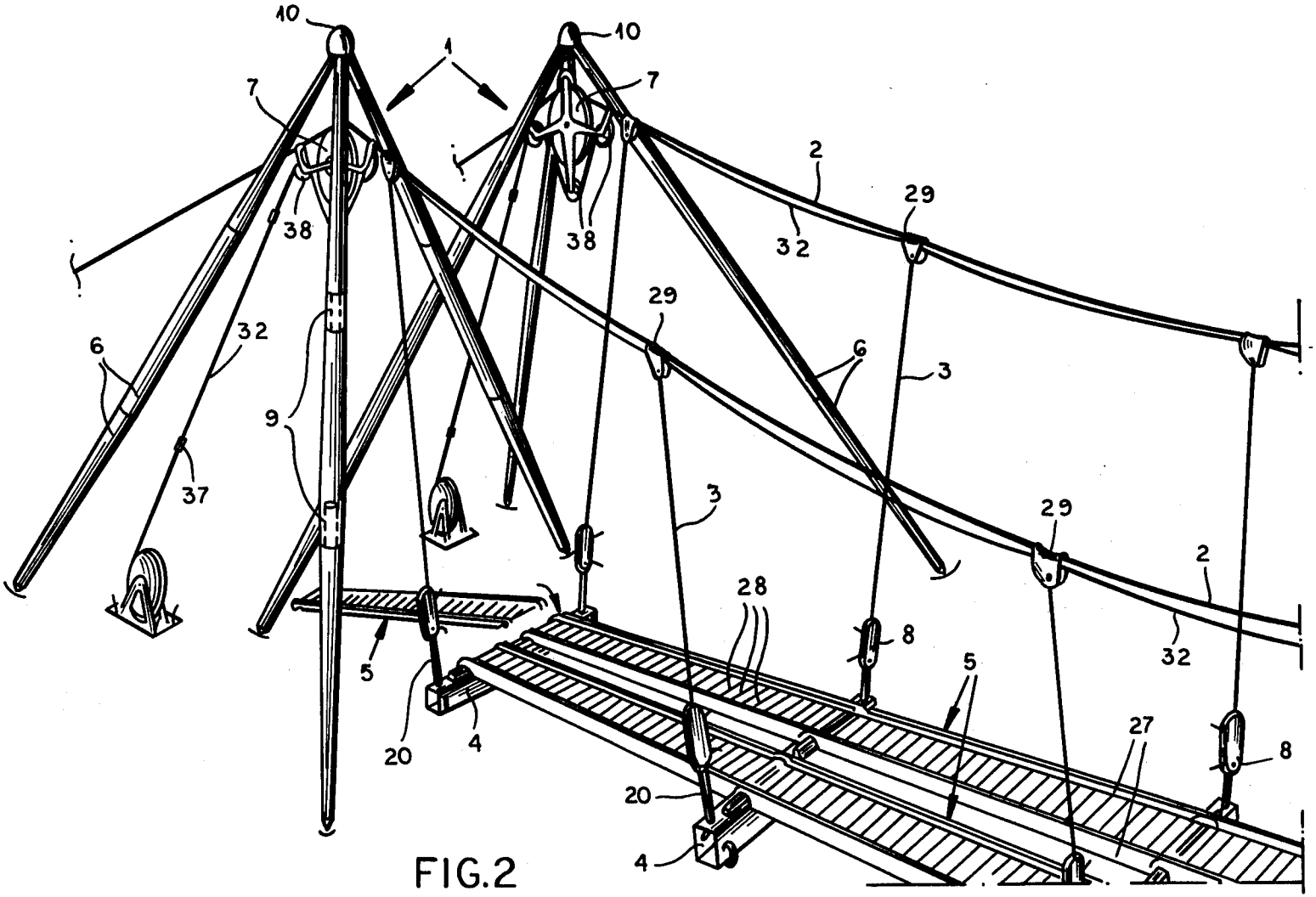
FIG. 2 is a view like FIG. 1 of a two-cable bridge.
Figure 4A:
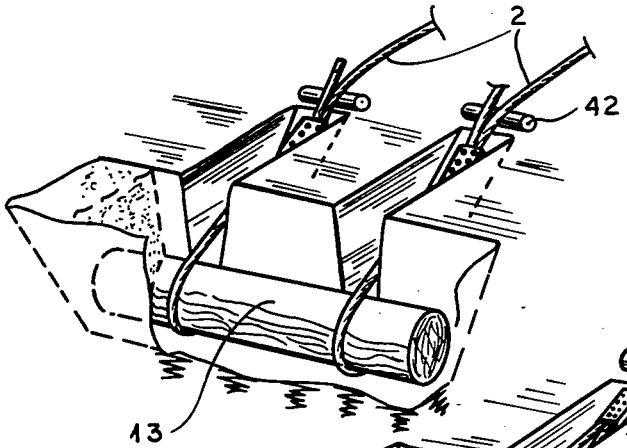
FIGS. 4*a* and 4*b* are perspective views illustrating anchoring systems for the bridge of this invention.
Figure 4B:
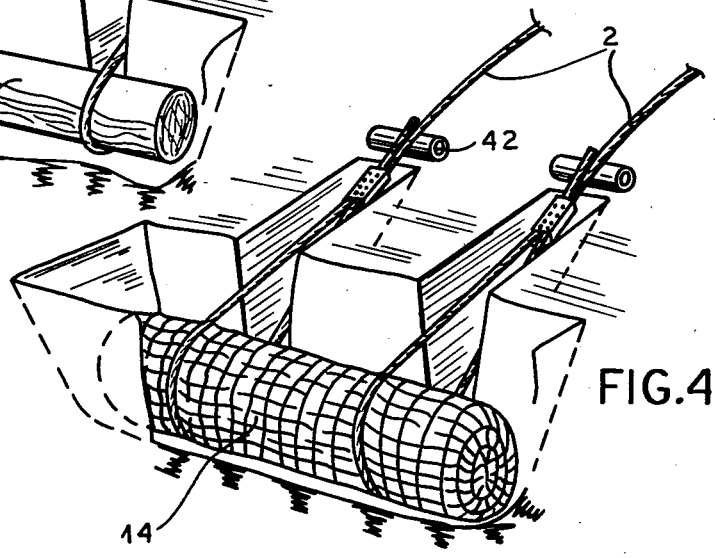

FIG. 2 shows the same arrangement as FIG. 1, except that two main catenary cables 2 extend parallel to each other between respective pairs of towers 1. The adjusters 8 are connected to respective transverse girders 4' that each supports two roadways formed of roadway sections 5, as shown in somewhat more detail in FIGS. 6, 6*a*, 6*b*, and 9. In such an arrangement the rear ends of the two cables 2 are looped at each end as shown in FIG. 4*a* over a large log 13 that is buried, with the cables being deflected over chairs 41 as is well known. It would also of course be possible to anchor the cable or cables 2 to an existing geological feature, such as a rock outcropping, or to secure it to an anchor such as shown in FIG. 4*b* which is formed of a mass of mixed rock wrapped up in wire mesh.

It would, of course, be possible to provide three or more such cables 2 extending parallel to each other between respective pairs of towers when considerable traffic must be handled by the bridge. In such case longer transverse girders 4 or fasteners between the ends of the girders 4 would be used.

Figure 5:
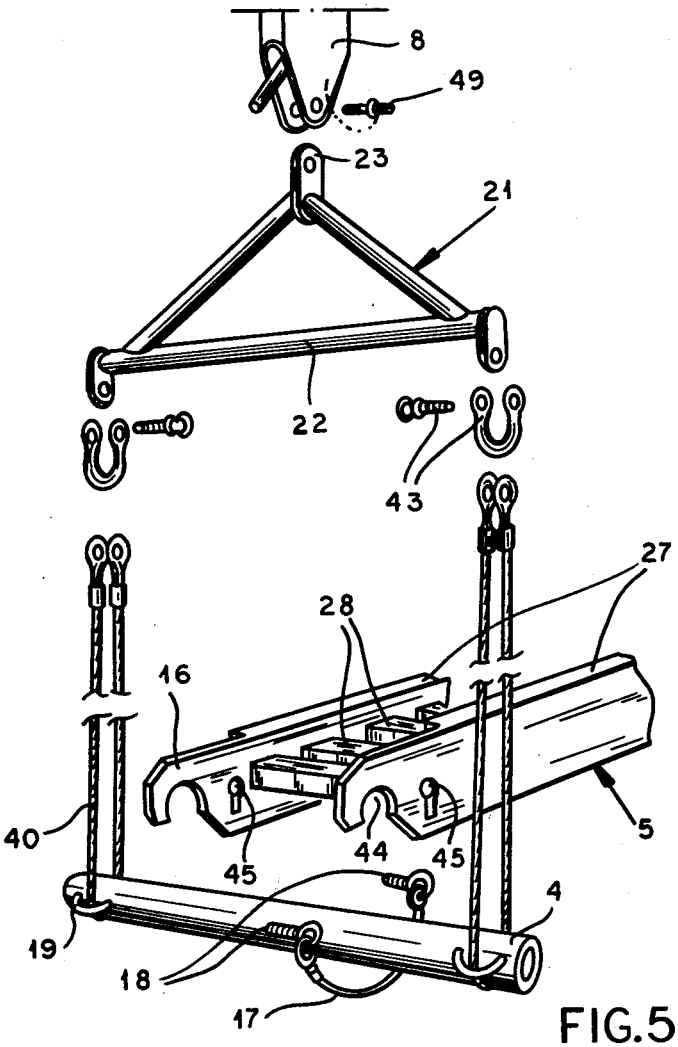
Figure 7:
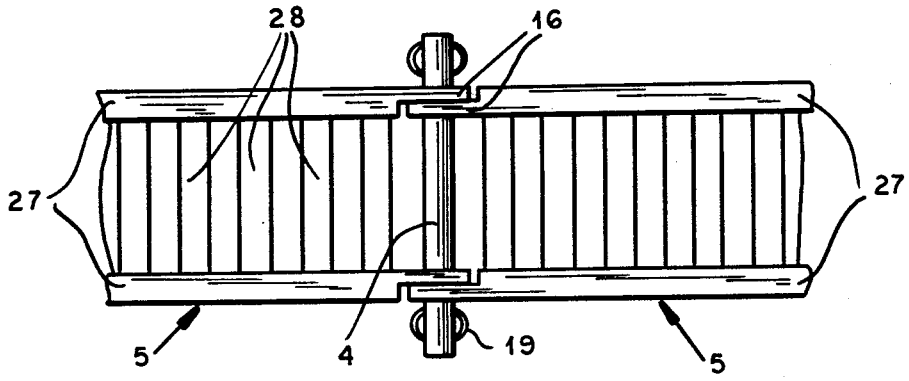
FIG. 7 is a bottom view of a detail of FIG. 1.
Figure 8:
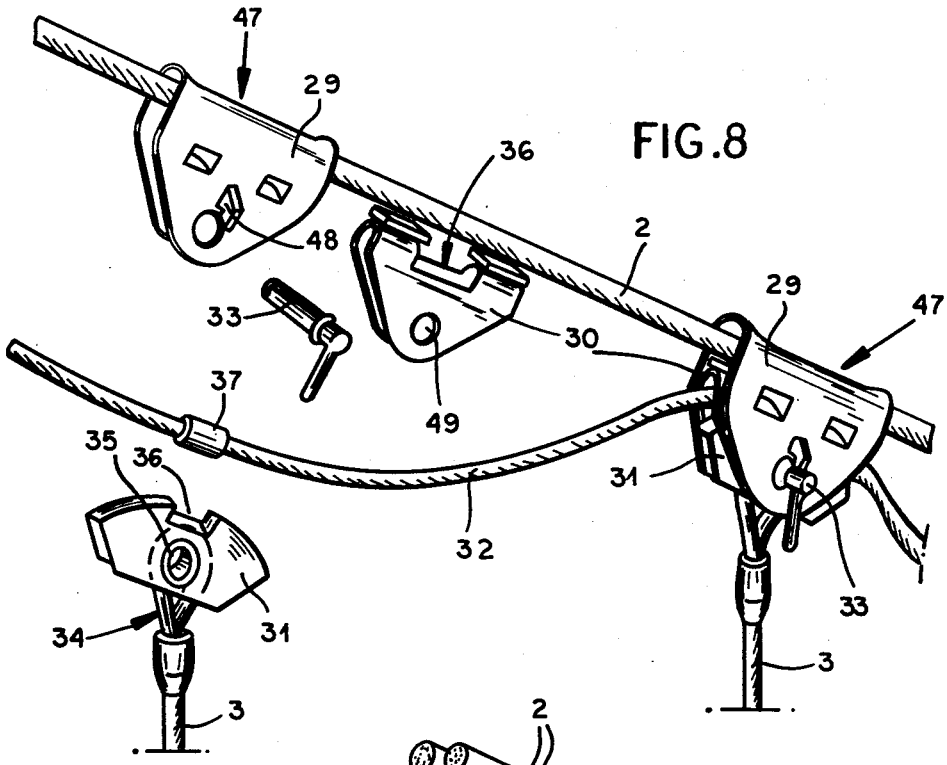
FIG. 8 is a large-scale perspective view of a detail of FIG. 1 showing one upper hanger assembly in assembled and one in exploded condition.
Figure 9:
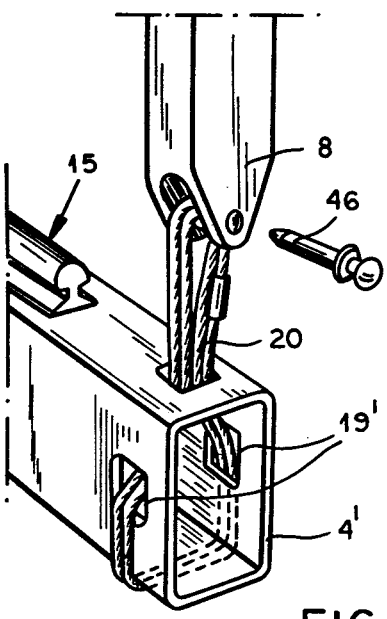
FIG. 9 is a large-scale exploded perspective view of a lower hanger assembly.

Each transverse girder 4 may be as seen in FIGS. 5 and 7 a simple piece of cylindrical pipe provided with eyes 19 through which pass hanger cables 40 connected at shackles 43 to an upper transverse member 22. A rigid triangular hanger 21 incorporating this member 22 has a central eye connected to the respective lifter or winch assembly 8. The roadway sections 5 have box-beam longitudinal members 27 bridged by transverse decking 28 and formed at their ends with half-thickness longitudinally projecting tabs 16 formed with cutouts 44 complementary to the transverse girder tube 4. Adjacent each end tab 16 each longitudinal girder 27 is formed with a keyhole-shaped hole 45. A short length 17 of cable has bolts 18 at its ends that fit in the holes 45 of aligned roadway sections 5 to prevent them from lifting up off the transverse girders 4.

It is also possible as shown in FIGS. 2, 6, 6*a*, 6*b*, and 9 for the two-cable bridge to have square-section transverse members 4*a* formed at their ends with holes 19' through which loops 20 of cable connected by pins 46 to the lever-operated winches 8 at the lower ends of the suspenders 3. Such girders 4' carry two T-section rails 15 having heads 24 over which the cutouts 44 of the end tabs 16 fit. No lanyard assembly 17, 18 is used here; instead holder plates 25 that fit over the head 24 of each rail 15 are brought to either side of two adjacent tabs 16 and clamped together by a bolt 26, thereby fixing the assembly tightly together while permitting limited transverse displacement of the roadway sections 5.

Figure 10:
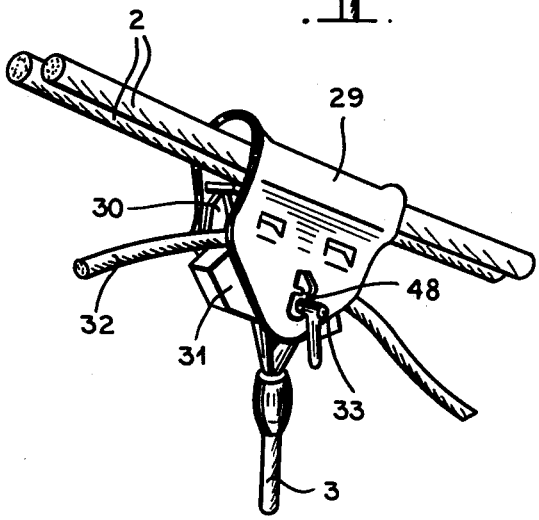
FIG. 10 is a large-scale view of an upper hanger assembly of the two-cable bridge of FIG. 2.

The upper ends of the suspenders 3 are connected via upper hanger assemblies 47 to the main cable 2 as shown in FIG. 7 or to the dual cables 2 as shown in FIG. 10. These assemblies 47 comprise main downwardly U-shaped slides or carriage plates 29 receiving respective downwardly U-shaped inner plates 30 and forming therewith a passage for the cable or cables 2. A further downwardly U-shaped and upwardly semicircular plate 31 is received in the plate 30 and forms a passage for a spacer cable 32 with it. The plates 30 and 32 are formed with mating cutouts 36 that together form a seat into which swaged-on spacer sleeves 37 on the cable 32 can fit. Thus the horizontal spacing between upper hanger assemblies 47, which must be roughly the same as the length of the roadway sections 5 between their cutouts 44, is established simply by the spacing of the fittings 37 on the spacer cable 32.

The upper end of each suspender 3 has a loop 34 fitted over a tube 35 spanning the two cheeks of the plate 31. A holder pin 33 extends through C-shaped holes 48 in the cheeks of the plate 29, aligned round holes 49 in the cheeks of the inner plate 30, and the sleeve 35. This pin 33 therefore holds the entire assembly 47 together. It can be pivoted about its transverse axis to clamp the cable or cables 2 between the plates 29 and 30, which is done once the cable 32 is taut as will be described below.

A bridge as shown in FIG. 1 is built as follows:

The two towers 1 are erected by two crews, one of which could be a single man, on the respective river banks, gorge edges, or the like. This is done by assembling leg sections 6 with disks 11 and a cap 10 and hanging the pulley assemblies 7, 38 from them. At the most accessible tower 1, hereinafter the main tower as compared to the outer tower which may be manned by a single person, a light leader line is threaded through the upper pulley 7 and is thrown across to the outer tower where it is also threaded through the upper pulley 7. Meanwhile the leading end of the spacer cable 32 is threaded through the pulleys 38. The leader line is used to pull through the main cable 2 and the spacer cable 32. The main cable 2 is then anchored as suggested by FIGS. 4*a* and 4*b* at the outer tower and the free end of the cable 38 is pulled through the pulleys 32 there and temporarily secured. The main cable 2 is then pulled tight and anchored at the main tower. Preferably the main cable 2 is pulled tight enough that at its lowest point it still hangs at least 2–3 m above a straight line drawn between the bases of the towers or between the levels where the roadway or path is to begin and end.

A person working from a stepladder at the main tower then puts together the upper assemblies 47 by first fitting a slide plate 29 over the cable 2 and then fitting another plate 30 under the plate 29. The cable 32 is fitted in turn into the plate 30, with one of its spacers 37 fitted in the notch 36 thereof. The segment 31 secured via the sleeve 35 to the loop 34 of the upper suspender end is then fitted into the plate 30, with its notch 36 engaged over the spacer 37, and the pin 33 is inserted.

Meanwhile the lower end of the suspender, which in this case is a simple steel cable having a loop 34 at one end, is threaded through the lever-operated ratchet winch 8 to which the yoke 21 is secured by the pin 49. The cables 40 are looped through the eyes 19 of one transverse girder 4 and their looped ends are secured by the shackles 43 to the respective ends of the transverse element 22 of the carrying yoke 21.

The mechanisms 8 are then operated to lift the girder 4 to a position just clear of the ground. Two end tabs 16 of a roadway section 5 are fitted to this suspended girder 4 and secured on it by cable assemblies 17, 18. The cable 32 is then payed out from the main tower or pulled in from the outer tower through a distance equal to the spacing between adjacent spacers 37. At the same time the roadway section 5 is pushed toward the outer tower through the same distance.

Another transverse girder 4 is hung from the cable 2 at the next spacer 37 in the manner described above, and the trailing-end tabs 16 of the already hung roadway section 5 are secured to this second girder 4 as well as the leading-end tabs 16 of a third section.

This process is continued until the roadway reaches all the way to the other side, with the bridge bring pushed out until it is at the bottom of the catenary of the cable 2, and then pulled in from the other side. At any stage the roadway formed by the sections 5 is quite stable and safe, so that it is possible for a person to walk along it. During such paying out the safety lines 39 are tied to the hanger cables 40 to both sides of the roadway. The sections 5 linked together at the girders 4 will form a catenary parallel to that of the cable 2.

Then the cable 32 is pulled tight at each end, thereby establishing a spacing between the upper ends of the suspenders 3 that is identical to the length of the roadway sections 5. This will move the suspenders from the vertical except if one happens to be at the center of the catenary of the cable 2. Going out from this center the suspenders incline increasingly outwardly, at increasingly acute angles up and away from the center. Such modest inclination imparts to these suspenders a slight stay function that greatly stabilizes the bridge of this invention. The slight increase in load can easily be allowed for in the suspender cables 3, and is more than outweighed by the convenience of erecting such a bridge.

Once the cable 32 is tight the levers 33 are rotated to lock the assemblies 47 on the cable 2 and the units 8 are operated to bring the roadway up into the most level position possible. The roadway can in fact be a straight line between the bases of the two towers if the cable 2 does not hang down at any point to a distance less than about 2.5 m above this straight line. This adjustment is done bit by bit, starting at the adjuster 8 of the lowest section 5 and working out gradually. As the roadway sections 5 are moved into horizontal positions the front and rear ends of the roadways they form will inherently move out from the center.

All of the above assembly operations are therefore carried out on firm ground. The bridge is constructed and then pulled and pushed across to the other side so that the assemblers are not exposed to danger by working out in the middle, and in fact the assembly location at the main tower can be covered with a tent to protect against the elements. No complex tools are required as everything fits together with pins that lock in place when the system is put under stress. The forces they resist are always perpendicular to them so that these pins have no tendency to loosen. All necessary adjustment can be carried out by a person standing stably on a roadway section 5.

In some situations where ready access can be had to both sides and speed is important, the roadway can be built from both ends and joined in the middle by a last roadway section 5. This would require that a cable 32 be payed out from each tower and that these cables 32 then be joined at the middle and pulled taut.

With the two-cable system of FIG. 2 the same general procedure is used, except that the yokes 21 are not used, since each girder 4' is suspended from two cables 3 having respective adjusters 8 connected directly to the respective loops 20 that are inseparable from the girder 4'. In addition the tabs 16 are secured by the bolts 26 and tabs 25. Such an arrangement therefore allows a bridge to be thrown up which can accommodate quite a bit of traffic.

We claim:

1. A suspension bridge comprising:

a pair of horizontally spaced towers;

a main catenary cable suspended from and extending between said towers;

a flexible spacer element extending along said main cable between said towers and provided with generally equispaced spacers;

respective hanger assemblies fixed at said spacers and slidable on said main cable between said towers;

respective upright hangers defining a vertical plane with said main cable and having upper ends connected to the respective hanger assemblies and lower ends;

respective means between said ends for shortening and lengthening the distance therebetween;

respective girders secured to said lower ends and extending generally perpendicular to said plane; and respective path sections extending generally horizontally and each having one end hooked over a respective one of said girders and another end hooked over an adjacent girder, said sections each having an effective length between the respective girders equal generally to the distance between adjacent spacers of said spacer element, said sections together forming a continuous path between said towers, said path section having ends formed with downwardly open recesses receiving the respective girders and linking each path section at each of its ends to the respective girder for pivoting relative thereto generally about the axis of the respective girder, said bridge further comprising means for securing the path-section ends down on the respective girders.

2. The suspension bridge defined in claim 1 wherein said towers each have a plurality of legs formed of longitudinally interfitted separable leg sections and a holder for the respective end of said main cable.

3. The suspension bridge defined in claim 2 wherein said leg sections are made of a light metal and are provided with interfittable ends.

4. The suspension bridge defined in claim 3 wherein each of said supports has at least three such legs and a cap at the upper ends thereof and provided with a pulley arrangement constituting the respective holder.

5. The suspension bridge defined in claim 3 wherein said legs have lower ends provided with horizontal disks by means of which they bear on the ground.

6. The suspension bridge defined in claim 3 wherein said legs have lower ends and said towers each comprise a closed loop of cable connected to the respective lower leg ends.

7. The suspension bridge defined in claim 1 wherein said girders are formed as generally cylindrical tubes and said means for securing includes respective cables attached underneath said tubes to path-section ends of adjacent path sections.

8. The suspension bridge defined in claim 7 wherein said hangers include suspender cables looped through said girders at the ends thereof.

9. The suspension bridge defined in claim 8 wherein said girders carry respective profiled support rails over which said recesses fit and to which the securing means secure said path-section ends.

10. The suspension bridge defined in claim 9 wherein said securing means includes respective pairs of holder plates longitudinally slidable along said rails and bolts securing each pair of holder plates to the sides of adjacent path-section ends.

11. The suspension bridge defined in claim 1 wherein said path sections each include two parallel box-beam longitudinal members and transverse members bridging same.

12. The suspension bridge defined in claim 1 wherein each hanger assembly includes three parts forming an upper passage for said main cable, a lower passage for said spacer element, and a transverse rod securing said parts together and securing a respective upper end of a hanger to them.

13. The suspension bridge defined in claim 12 wherein said spacer element is a cable and said spacers are sleeves fixed thereon, said parts forming a seat for the respective spacer.

14. A method of building a suspension bridge including:

a pair of horizontally spaced towers;

a main catenary cable suspended from and extending between said towers;

a flexible spacer element extending along said main cable between said towers and provided with generally equispaced spacers;

respective hanger assemblies fixed at said spacers and slidable on said main cable between said towers;

respective upright hangers defining a vertical plane with said main cable and having upper ends connected to the respective hanger assemblies and lower ends;

respective mechanisms between said ends for shortening and lengthening the distance therebetween;

respective girders secured to said lower ends and entending generally perpendicular to said plane; and respective path sections extending generally horizontally and each having one end hooked over a respective one of said girders and another end hooked over an adjacent girder, said sections each having an effective length between the respective girders equal generally to the distance between adjacent spacers of said spacer element, said sections together forming a continuous path between said towers, said method comprising the steps sequentially:

(a) erecting said towers;

(b) drawing said main cable between the erected towers;

(c) slidably fitting at one of the towers a hanger assembly to the spanned main cable and securing it to a respective one of said spacers of said spacer element and securing a hanger to this hanger assembly and a girder to this hanger to form a hanger unit slidable along the main cable and attached to said respective one spacer;

(d) pivotally coupling one end of a path section to the girder of the hanger unit of step (c) at the one tower;

(e) pulling said spacer unit from one tower toward the other tower thereby drawing the one spacer with the respective hanger unit attached to it from said one tower toward the other tower through a distance along said main cable equal generally to said distance between adjacent spacers on said spacer element;

(f) repeating step (c) with the next spacer along said spacer element and pivotally coupling the other end of the path section of step (d) and one end of yet another path section to the girder of the thus formed hanger unit, all still at the one tower;

(g) repeating steps (d), (e), and (f) with successive hanger assemblies, hangers, girders, and roadway sections to form of the sections a continuous path extending between said towers; and (h) adjusting the distance between the upper and lower end of said hangers by means of said mechanisms to straighten said path.

* * * * *